US007272955B2

(12) United States Patent
Fert

(10) Patent No.: US 7,272,955 B2
(45) Date of Patent: Sep. 25, 2007

(54) COOLING APPARATUS AND PROCESS

(75) Inventor: Philippe Fert, Faucon (FR)

(73) Assignee: L'Air Liquide, Societe Anonyme a Directoire et Conseil de Surveillanc pour l'Etude et l'Exploitation des Procedes Georges Claude, Paris (FR)

( * ) Notice: Subject to any disclaimer, the term of this patent is extended or adjusted under 35 U.S.C. 154(b) by 368 days.

(21) Appl. No.: 11/011,276

(22) Filed: Dec. 13, 2004

(65) Prior Publication Data

US 2006/0123843 A1 Jun. 15, 2006

(51) Int. Cl.

| | |
|---|---|
| ***F25J 3/00*** | (2006.01) |
| ***F28D 5/00*** | (2006.01) |
| ***F28C 1/14*** | (2006.01) |
| ***F28C 3/06*** | (2006.01) |

(52) U.S. Cl. ..... 62/648; 62/310; 261/159; 261/DIG. 11

(58) Field of Classification Search ..... 62/648, 62/310; 261/159, 160, DIG. 11
See application file for complete search history.

(56) References Cited

U.S. PATENT DOCUMENTS

| | | | | |
|---|---|---|---|---|
| 3,722,226 A | | 3/1973 | McDermott et al. | |
| 5,306,331 A | * | 4/1994 | Auvil et al. | 95/42 |
| 5,329,758 A | * | 7/1994 | Urbach et al. | 60/775 |
| 5,505,050 A | | 4/1996 | Arriulou et al. | |
| 5,622,044 A | * | 4/1997 | Bronicki et al. | 60/39.182 |
| 2003/0209020 A1 | | 11/2003 | Klein | |
| 2004/0074850 A1 | * | 4/2004 | Kelly | 210/806 |

FOREIGN PATENT DOCUMENTS

| | | |
|---|---|---|
| EP | 1 148 296 | 10/2001 |
| WO | WO 2005 114082 | 12/2005 |

OTHER PUBLICATIONS

European Search Report for PCT/EP2005/056380.
Wilson, K.B., et al.: *Air purification for cyrogenic air separation units*, IOMA Broadcaster, International Oxygen Manufacturers Assoc., Cleveland, OH, Jan. 1984, pp. 15-20.

* cited by examiner

*Primary Examiner*—William C Doerrler
(74) *Attorney, Agent, or Firm*—Elwood Haynes

(57) ABSTRACT

An integrated cooling apparatus and process which includes a source of compressed gas; a cooling unit for cooling the compressed gas to form cooled compressed gas by heat exchange with water having a first purity, thereby producing a stream of cooled compressed gas and a stream of warmed water having the first purity; a first heat exchanger for warming a stream of water having a second purity, the second purity being lower than the first purity, by indirect heat exchange with a stream of water having the first purity; and a conduit for sending cooled water having the first purity to the cooling unit.

6 Claims, 1 Drawing Sheet

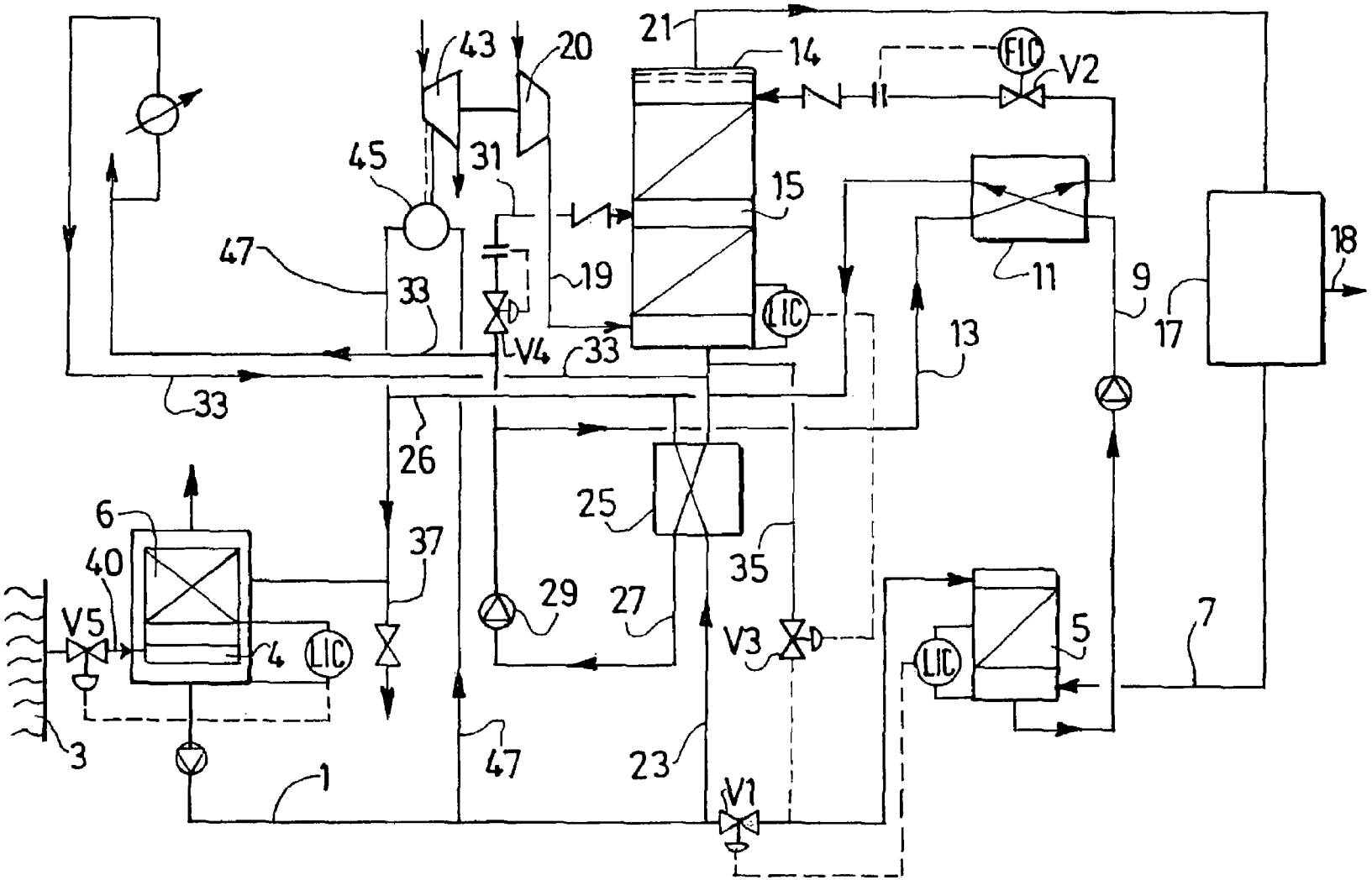
18
17
9
7
V2
FIC
11
5
13
LIC
14
15
LIC
35
V3
V1
21
23
25
27
19
33
20
29
V4
31
43
47
33
26
37
45
LIC
1
47
4
33
6
40
V5
3

COOLING APPARATUS AND PROCESS

BACKGROUND

When a natural resource is available at a remote site, it is frequently required to set up an industrial plant to treat the natural resource without the usual infrastructures and utilities available. In particular, when the site is close to the sea in a desert area, it is desirable to use seawater for cooling purposes on the site and to minimize the consumption of soft water.

The present invention allows the use of an impure source of water for cooling purposes in an industrial plant.

Industrial plants frequently include an air separation unit. Such plants commonly chill down cooling water by direct contact with a waste gas from the air separation unit and then cool down a compressed air flow by direct contact with the chilled water. This latter direct heat exchange between chilled water and compressed air requires a water quality which cannot be met by impure water, such as, for instance, seawater.

The solution to the problem is to use a waste gas of the air separation plant to chill the impure water (e.g., sea water) by direct contact between impure water and the waste gas, and then to exchange heat between the impure chilled water and a closed circuit of soft water. The produced chilled soft water can then be used for cooling the airflow by direct contact.

SUMMARY OF THE INVENTION

According to an object of the invention, there is provided a cooling apparatus comprising a cooling unit for cooling compressed gas to form cooled compressed gas by heat exchange with water having a first purity, thereby producing a stream of cooled compressed gas and a stream of warmed water having the first purity; a first heat exchanger for warming a stream of water having a second purity, the second purity being lower than the first purity, by indirect heat exchange with a stream of water having the first purity; and a conduit for sending cooled water having the first purity to the cooling unit.

The water of the first purity contains a smaller molar percentage of a given impurity (such as salt) than the water of the second purity. In particular, the water of the first purity may be soft water and the water of the second purity may be impure water, such as seawater.

According to another object of the invention, there is provided a cooling process comprising cooling a compressed gas to form cooled compressed gas by heat exchange with water having a first purity; warming a stream of water having a second purity, the second purity being lower than the first purity, by indirect heat exchange in a first heat exchanger with a stream of water having the first purity to produced cooled water having the first purity; and sending at least part of the cooled water having the first purity to the cooling unit.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1 illustrates an example of an integrated cooling apparatus according to the invention.

DESCRIPTION OF THE PREFERRED EMBODIMENTS

The invention provides a cooling apparatus comprising a cooling unit for cooling compressed gas to form cooled compressed gas by heat exchange with water having a first purity, thereby producing a stream of cooled compressed gas and a stream of warmed water having the first purity; a first heat exchanger for warming a stream of water having a second purity, the second purity being lower than the first purity, by indirect heat exchange with a stream of water having the first purity; and a conduit for sending cooled water having the first purity to the cooling unit.

The water of the first purity contains a smaller molar percentage of a given impurity (such as salt) than the water of the second purity. In particular, the water of the first purity may be soft water and the water of the second purity may be impure water, such as seawater.

The apparatus may comprise a second heat exchanger which is a direct contact heat exchanger; a conduit for sending a stream of water having the second purity to the second heat exchanger; a conduit for sending at least part of at least one stream from a cryogenic distillation unit to the second heat exchanger so as to cool the stream of water having the second purity; and a conduit for sending the cooled stream of water having the second purity to the first heat exchanger.

The cooling unit may be an indirect contact or a direct contact heat exchanger.

The stream from the cryogenic distillation unit is preferably selected from the group consisting of nitrogen-rich gas, argon-rich gas, and oxygen-rich gas.

If the compressed gas is air, the apparatus comprises a conduit for sending the compressed gas to the cryogenic distillation unit as feed.

The compressed gas may be a product of the cryogenic distillation unit.

Additionally, the invention provides a cooling process comprising cooling a compressed gas to form cooled compressed gas by heat exchange with water having a first purity; warming a stream of water having a second purity, the second purity being lower than the first purity, by indirect heat exchange in a first heat exchanger with a stream of water having the first purity to produced cooled water having the first purity; and sending at least part of the cooled water having the first purity to the cooling unit.

The process may comprise sending a stream of water having the second purity to a second heat exchanger, sending at least part of at least one stream from a cryogenic distillation unit to the second heat exchanger so as to cool the stream of water having the second purity, and sending the cooled stream of water having the second purity to the first heat exchanger.

The compressed gas may be air and the process may comprise sending the compressed gas to the front end purification and then to the cryogenic distillation unit as feed.

The compressed gas may be a product of the cryogenic distillation unit.

Referring to FIG. 1, a cryogenic air separation unit 17 is located in proximity to a source 3 of impure water, such as a lake or the sea. The impure water 1 is pumped from the basin 4 of the main wet cooling tower 6 and a fraction of this water 9 is sent to the top of a direct contact tower 5 in which the impure water flow is chilled by direct contact with a waste dry gas 7. The waste dry gas is preferably nitrogen-rich gas 7 from the cryogenic air separation unit 17. The nitrogen-rich gas 7 is at a temperature between 5 and 40° C. and completely dry, and thereby chills the impure water 9 by production of the latent heat of evaporation to form chilled impure water. The temperature required for the nitrogen-rich gas is typically that at which the gas is removed from the warm end of a main heat exchanger of the air separation unit 17. The flow of impure water 9 is controlled by a valve V1 that is controlled by an LIC that detects the liquid level at the base of the tower 5. The impure water 9 is pumped to a heat exchanger 11 where it exchanges heat with a stream of pure water 13 to form chilled pure water.

The stream of pure water 13 is sent to the top of a further direct contact cooling tower 15 which is used to cool an air stream 19 from the main air compressor 20 of the air separation unit 17 or of another air separation unit. The pure water 13 is sent to a point below the demister 14 and a valve V2 controls the flow. The cooled air 21 emerging from the top of the further cooling tower 15 is sent to a purification unit (not shown), cooled, and then sent to the columns of the cryogenic air separation unit 17. The air separation unit 17 produces oxygen 18 and possibly argon for use on the site, for example, in a gas-to-liquid conversion unit or other similar process consuming very large amounts of oxygen.

A further fraction of the impure water 23 is sent to exchanger 25 where it cools pure water stream 27 coming from the further cooling tower 15.

Downstream of heat exchanger 11, the impure water 9 is mixed with the impure water 23 warmed in exchanger 25 to form stream 26. Stream 26 is then sent back to the wet cooling tower 6 where it is cooled by direct contact with an ambient air flow induced or fan forced evaporation. The cooled impure water falling into basin 4 is then recycled to the system.

The pure water 27 is pumped by pump 29 and divided into three streams. Stream 13 is sent to exchanger 11, stream 31 is sent to an intermediate level of the further cooling tower 15 via valve V4 at a higher temperature than that at which stream 13 enters the cooling tower 15 as cooled water, and stream 33 is sent to other pure water consumers, for example, cooling circuits on the site (e.g., compressor intercoolers). Warmed stream 33 is then mixed with the rest of the water from the bottom of the cooling tower 15 to form stream 27.

It will be noted that cooling tower 15, which is a direct contact heat exchanger, could be replaced by an indirect contact heat exchanger.

It will be appreciated that the gas 19 cooled in further cooling tower 15 could be any gas requiring cooling.

The pure water volume in the circuit increases since humidity present in compressed air stream 19 is condensed in cooling tower 15. This water contains no dissolved minerals and is slightly acidic due to the carbonic acid produced by the carbon dioxide present in the air. It is generally not necessary to neutralize this water to avoid corrosion. However, it may be useful to inject soda to control the pH. The water level in the further cooling tower 15 is controlled using a purge 35 whose volume corresponds to the volume of water condensed in the tower. Extra water from condensed water in air must be removed at least from time to time. This purged water 35 can be injected into the impure water circuit (dashed lines) or can be used as a source of relatively pure water for another application. The flow of purged water is controlled by a valve V3 that is controlled by an LIC which monitors the liquid level at the bottom of tower 15.

A blow down purge 37 is used to maintain the impure water concentration within acceptable range so the salt concentration does not increase overduly.

Impure water 40 is added through valve V5 controlled by the level in the basin 4 via an LIC at least from time to time to compensate for the water lost via purge 37 and the evaporation and drift losses.

The compressor 20 of the air separation 17 is commonly driven by a steam turbine 43. The stream turbine condenser 45 may be cooled using part 47 of the impure water and the warmed impure water 47 is then sent back to the wet cooling tower 6. It will be appreciated that the steam turbine need not be present since the compressor 20 could be driven by other means.

It will be seen that the apparatus does not consume any water apart from impure water 40. Since the only water in contact with the gas to be cooled is pure, there is no risk of contaminating the gas.

The volume of the pure water circuit is reduced and there is consequently no risk of flooding the cooling tower or of water drifting toward sensitive downstream equipment such as the front-end purification unit of the air separation unit 17.

It will be appreciated that while one embodiment of the invention has been shown and described hereinabove, many modifications may be made by the person skilled in the art without departing from the spirit and scope of this invention.

What is claimed is:

1. An integrated cooling apparatus comprising:

a) a source of compressed gas;

b) a cooling unit for cooling the compressed gas to form cooled compressed gas by heat exchange with water having a first purity thereby producing a stream of cooled compressed gas and a stream of warmed water having the first purity;

c) a first heat exchanger for warming a stream of water having a second purity, wherein the second purity is lower than the first purity, by indirect heat exchange with a stream of water having the first purity; and d) a conduit for sending cooled water having the first purity to the cooling unit, e) a second heat exchanger which is a direct contact heat exchanger;

f) a conduit for sending a stream of water having the second purity to the second heat exchanger;

g) a conduit for sending at least part of at least one stream from a cryogenic distillation unit to the second heat exchanger so as to cool the stream of water having the second purity; and h) a conduit for sending the cooled stream of water having the second purity to the first heat exchanger.

2. The apparatus of claim 1, wherein the stream from the cryogenic distillation unit is selected from the group consisting of:

a) nitrogen-rich gas;

b) argon-rich gas; and c) oxygen-rich gas.

3. An integrated cooling apparatus comprising:

a) a source of compressed gas;

b) a cooling unit for cooling the compressed gas to form cooled compressed gas by heat exchange with water having a first purity thereby producing a stream of cooled compressed gas and a stream of warmed water having the first purity;

c) a first heat exchanger for warming a stream of water having a second purity, wherein the second purity is lower than the first purity, by indirect heat exchange with a stream of water having the first purity; and d) a conduit for sending cooled water having the first purity to the cooling unit, wherein the compressed gas is a product of a cryogenic distillation unit.

4. The apparatus of claim 1, further comprising a third heat exchanger and a conduit for sending warmed water having the first purity from the cooling unit to the third heat exchanger and a conduit for sending impure water of the second purity to the third heat exchanger.

5. A cooling process comprising:

a) cooling a compressed gas to form cooled compressed gas by heat exchange with water having a first purity;

b) warming a stream of water having a second purity, wherein the second purity is lower than the first purity, by indirect heat exchange in a first heat exchanger with a stream of water having the first purity to produce cooled water having the first purity; and c) sending at least part of the cooled water having the first purity to the cooling unit, d) sending a stream of water having the second purity to a second heat exchanger;

e) sending at least part of at least one stream from a cryogenic distillation unit to the second heat exchanger so as to cool the stream of water having the second purity; and f) sending the cooled stream of water having the second purity to the first heat exchanger.

6. A cooling process comprising:

a) cooling a compressed gas to form cooled compressed gas by heat exchange with water having a first purity;

b) warming a stream of water having a second purity, wherein the second purity is lower than the first purity, by indirect heat exchange in a first heat exchanger with a stream of water having the first purity to produce cooled water having the first purity; and c) sending at least part of the cooled water having the first purity to the cooling unit, wherein the compressed gas is a product of a cryogenic distillation unit.

* * * * *